US011193275B2

(12) United States Patent
Dickson

(10) Patent No.: US 11,193,275 B2
(45) Date of Patent: Dec. 7, 2021

(54) PANEL STORAGE SYSTEM AND DEVICES

(71) Applicant: Advanced Equipment Corporation, Fullerton, CA (US)

(72) Inventor: Scott Dickson, Brea, CA (US)

(73) Assignee: Advanced Equipment Corporation, Fullerton, CA (US)

( * ) Notice: Subject to any disclaimer, the term of this patent is extended or adjusted under 35 U.S.C. 154(b) by 109 days.

(21) Appl. No.: 16/592,252

(22) Filed: Oct. 3, 2019

(65) Prior Publication Data

US 2020/0032508 A1 Jan. 30, 2020

Related U.S. Application Data

(62) Division of application No. 15/412,414, filed on Jan. 23, 2017, now Pat. No. 10,465,383.

(51) Int. Cl.

| | |
|---|---|
| ***E04B 2/82*** | (2006.01) |
| ***E05D 15/06*** | (2006.01) |
| ***E05F 15/643*** | (2015.01) |

(52) U.S. Cl.

CPC ..... *E04B 2/827* (2013.01); *E05D 15/0608* (2013.01); *E05D 15/0613* (2013.01); *E05F 15/643* (2015.01); *E05Y 2900/142* (2013.01)

(58) Field of Classification Search

CPC ..... E04B 2/827; E05Y 2900/142; E05D 15/0608; E05D 15/0613; E05D 15/063; E05F 15/643

See application file for complete search history.

(56) References Cited

U.S. PATENT DOCUMENTS

| | | | | |
|---|---|---|---|---|
| 4,569,164 | A | 2/1986 | Dickson | |
| 5,022,454 | A | 6/1991 | Kobayashi et al. | |
| 5,065,806 | A | 11/1991 | Kondoh | |
| 5,133,398 | A * | 7/1992 | Yang | E06B 9/0638 160/202 |
| 5,172,742 | A | 12/1992 | Iwasaki et al. | |
| 5,230,123 | A | 7/1993 | Williams et al. | |
| 5,406,761 | A | 4/1995 | Hobbiebrunken et al. | |
| 5,685,355 | A * | 11/1997 | Cook | E06B 9/0638 160/201 |
| 5,930,953 | A * | 8/1999 | Estfeller | E05F 15/638 49/127 |
| 6,267,169 | B1 * | 7/2001 | McDonald | E05D 15/262 160/193 |
| 6,868,891 | B2 * | 3/2005 | Cohen-Ravid | E06B 9/063 160/32 |
| 7,228,664 | B2 | 6/2007 | Clark | |
| 7,454,868 | B2 | 11/2008 | Clark | |
| 8,424,244 | B2 | 4/2013 | Lloret | |
| 8,468,751 | B2 | 6/2013 | Williams | |

(Continued)

FOREIGN PATENT DOCUMENTS

WO 1998027306 A1 6/1998

*Primary Examiner* — Justin B Rephann

(74) *Attorney, Agent, or Firm* — Barry IP Law, P.C.

(57) ABSTRACT

A wall panel storage system includes a looped element and a motor for driving the looped element. A plurality of spacers are attached to the looped element with at least one spacer of the plurality of spacers being configured to fit vertically or be inserted between a pair of panels to move a panel of the pair of panels into or out of a storage area along a storage track when the motor drives the looped element.

21 Claims, 5 Drawing Sheets

(56) References Cited

U.S. PATENT DOCUMENTS

| | | | |
|---|---|---|---|
| 9,359,804 | B2 | 6/2016 | Dickson |
| 2005/0086876 | A1 | 4/2005 | Clark |
| 2005/0126721 | A1 | 6/2005 | Fan |
| 2016/0251852 | A1 | 9/2016 | Dickson |
| 2018/0363345 | A1 | 12/2018 | Header |

* cited by examiner

PANEL STORAGE SYSTEM AND DEVICES

CROSS-REFERENCE TO RELATED APPLICATION

This application is a divisional application of U.S. patent application Ser. No. 15/412,414, entitled "PANEL STORAGE SYSTEM AND DEVICES", filed on Jan. 23, 2017, the entire contents of which are hereby incorporated by reference.

FIELD

The present disclosure relates to storing panels used to partition a room. More particularly, the present disclosure relates to a system for feeding panels from and receiving panels into a storage area.

BACKGROUND

Partitions are often used to divide large rooms such as theaters, conference rooms, convention halls or gymnasiums. Such partitions can include panels that hang from an overhead track and slide or unfold horizontally along the track from a storage location to partition a room. Such partitions often require a team of many people to move panels out of or into a storage area and to move the panels along a track. Even advanced systems that may include automation to move panels into place can still require people and time to move the panels into or out of a storage area.

In addition, panel storage areas can take up a relatively large area to allow for storage of all of the panels and to provide room for an operator to access the panels. The storage of panels and the need to manually access the panels generally does not provide for an efficient use of space in the storage area. Furthermore, conventional panel storage may not allow for the tracking of panels into or out of the storage area.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure and not to limit the scope of what is claimed.

DETAILED DESCRIPTION

In the following detailed description, numerous specific details are set forth to provide a full understanding of the present disclosure. It will be apparent, however, to one of ordinary skill in the art that the various embodiments disclosed may be practiced without some of these specific details. In other instances, well-known structures and techniques have not been shown in detail to avoid unnecessarily obscuring the various embodiments.

Figure 1:
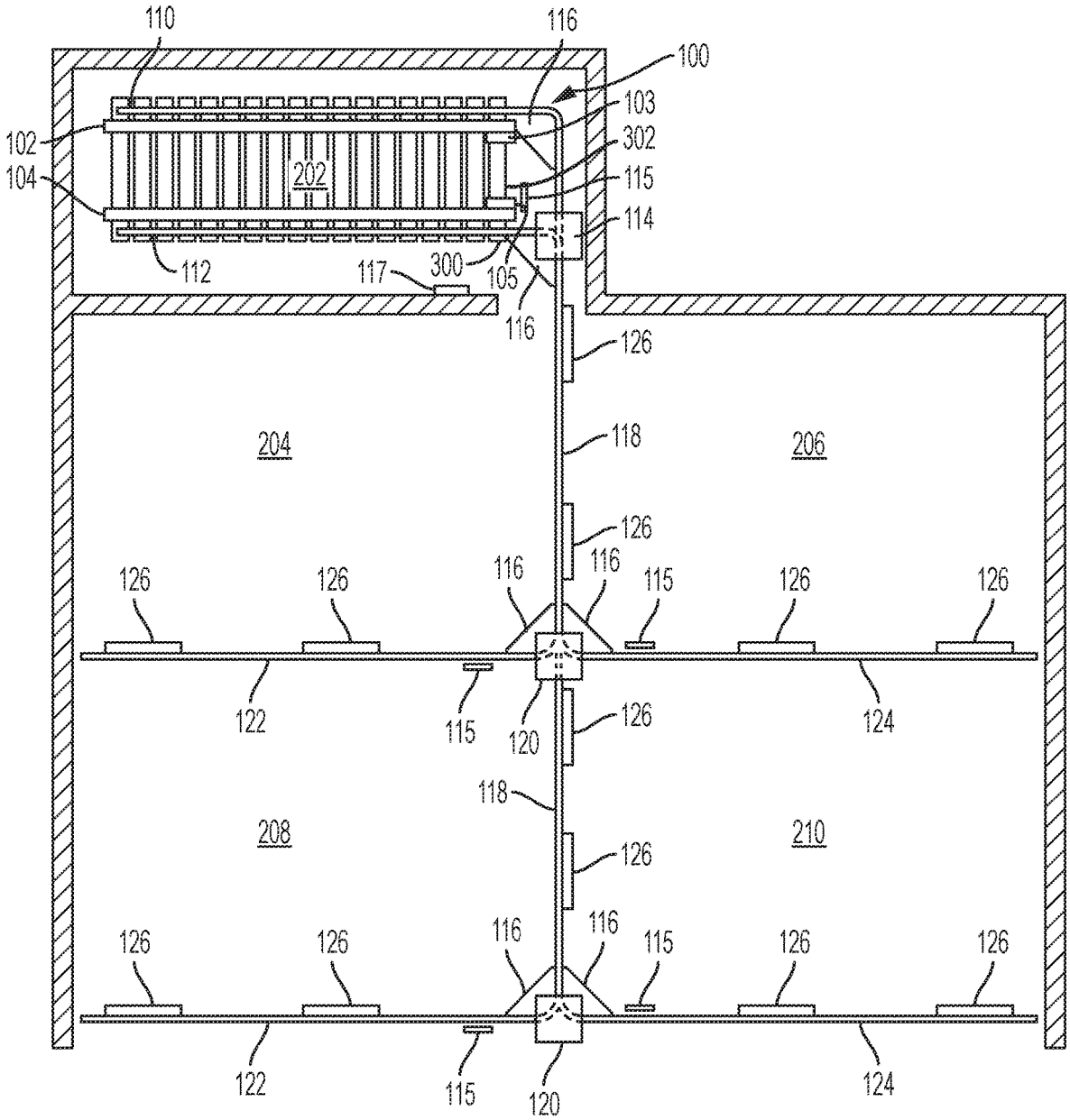
FIG. 1 depicts an overview of a wall partition movement system and a panel storage system according to an embodiment.

FIG. 1 depicts an overview of a wall partition movement system and wall panel storage system 100 according to an embodiment. As shown in FIG. 1, wall panel storage system 100 is used for storing panels 300 when they are not deployed as wall partitions defining rooms or spaces 204, 206, 208, or 210, along main track 118 or auxiliary tracks 122 and 124.

In the example of FIG. 1, the wall partition movement system includes drive mechanisms 126 adjacent main track 118, and adjacent auxiliary tracks 122 and 124. Each of the drive mechanisms 126 is configured to drive panels 300 along the track by driving the panels from one drive mechanism 126 to the next drive mechanism 126. A further description of such a wall partition movement system can be understood with reference to U.S. Pat. No. 9,359,804, filed on May 28, 2014, entitled "WALL PARTITION MOVEMENT SYSTEMS AND METHODS", and U.S. Pat. No. 10,196,815, filed on May 6, 2016, entitled "WALL PARTITION MOVEMENT SYSTEMS AND METHODS", the entire contents of both of which are hereby incorporated by reference.

The wall partition movement system of FIG. 1 includes corner drive mechanisms 116, which move (i.e., push or pull) panels 300 around a turn joining main track 118 with an auxiliary track 122 or 124. Corner drive mechanisms 116 can allow panels 300 to change a direction of travel. An example of a corner drive mechanism 116 used in panel storage system 100 is discussed below in more detail with reference to FIG. 3.

Track switches 120 can be used to switch the track followed or engaged by trollies of panels 300. In some implementations, the trollies may include one or more wheels that allow panels 300 to travel along the tracks. Track switches 120 in FIG. 1 include connector tracks that can connect main track 118 to one of auxiliary track 122 or 124, or maintain connection to main track 118. In this regard, track switches 120 can be double track switches that can switch the connection to main track 118, auxiliary track 122, or auxiliary track 124.

When not in use, panels 300 are stored in storage area 202 and suspended from storage tracks 110 and 112, which support panels 300. As shown in FIG. 1, storage tracks 110 and 112 are orientated perpendicular to main track 118, excluding any transition portions of storage tracks 110 and 112, or main track 118.

As used herein, a storage area generally refers to an area where panels 300 are stored by wall panel storage system 100. Storage area 202 in FIG. 1 includes the area below panel storage devices 102 and 104 of wall panel storage system 100 that is occupied by panels 300 when in storage.

When needed to form a wall partition, panels 300 are driven out of storage area 202 using wall panel storage system 100, which includes a first wall panel storage device 102 and a second wall panel storage device 104, adjacent storage tracks 110 and 112, respectively. In the example of FIG. 1, wall panel storage system 100 also includes two corner drive mechanisms 116, single track switch 114, panel identifier detector 115, and controller 117.

As shown in the example of FIG. 1, first wall panel storage device 102 and second wall panel storage device 104 include a first motor 103 and a second motor 105, respectively. As discussed in more detail below, each motor may operate simultaneously to drive a respective looped element (e.g., a belt or a chain) that includes a plurality of spacers attached to the looped element to move the panels into or out of storage area 202. As used herein, attached can mean that the spacers are affixed mechanically or otherwise to the looped element, or integral to the looped element. In other implementations, the looped elements of the first and second wall panel storage devices 102 and 104 may be driven by one shared motor instead of each being driven by their own motor. In yet other implementations, each of panel storage device 102 and 104 may include multiple motors for driving a looped element.

Wall panel storage system 100 in the example of FIG. 1 also includes panel identification detector 115 configured to detect an identifier 302 on each panel 300 that identifies the panel. As discussed in more detail below with reference to FIGS. 2 and 4, one or more panels 300 can include an identifier such as a bar code, QR code, or transponder that can be read or detected by panel identification detector 115 to identify the panel to controller 117.

For example, different panels 300 may have different capabilities or constructions that allow the panels to serve a particular function. In one example, a panel may be identified by its identifier as a pass-door panel that includes a doorway. In another example, a panel may be identified by its identifier as a jam panel that has a seal that can be expanded against a wall. Each panel may also be uniquely identified to associate maintenance information with the panel, such as an indication of how long the panel has been in service or if the panel is moving quicker or slower through different portions of the wall partition movement system or wall panel storage system 100.

For example, controller 117 may monitor a motor current needed to move a particular panel along a drive mechanism 126 or a corner drive mechanism 116. Controller 117 may then compare a recent motor current used to move the panel to an earlier motor current needed to move the same panel, or to a threshold current to determine if the recent current falls below the threshold current or if the difference between the recent current and an earlier current is greater than a threshold difference. Such changes in the current needed to move the panel may indicate that a trolley of the panel is in need of replacement due to wear, since the amount of force needed to move panels often decreases over time due to wear on the trollies. Controller 117 may then provide an indication, such as an alert on a display of controller 117, or via a text message, email, or webpage, that a trolley of the particular panel may need replacement.

Identification detector 115 can identify the different panels as they enter and/or leave storage area 202 so that the wall partition movement system can automatically direct the proper panel to an intended location using drive mechanisms 126, corner drive mechanisms 116, and track switches 120. As shown in FIG. 1, additional panel identification detectors can be located along auxiliary tracks 122 and 124 to further monitor and direct the location of panels.

In some implementations, sensors in addition to, or in place of panel identification detectors 115 can be used to provide an indication of a location of a panel entering or exiting panel storage system 100, along main track 118, and/or along auxiliary tracks 122 and 124. Such sensors can include a proximity sensor, such as an electromagnetic or inductive sensor. In other implementations, the sensors can include an optical sensor, or a physical contact sensor or switch. Controller 117 can use the panel location information provided from such sensors and/or panel identification detectors 115 to turn particular drive mechanisms on or off, to control a speed of a drive mechanism, or to switch a track switch.

Controller 117 can include a Programmable Logic Controller (PLC) or a microprocessor controller that executes computer readable instructions stored in a memory of controller 117 to control operation of wall panel storage system 100, drive mechanisms 126, corner drive mechanisms 116, and/or track switches 120. In this regard, controller 117 can sequence the turning on and off of wall panel storage system 100 based on a user input at controller 117 or remote from controller 117, as in a case where controller 117 also acts as a web server that can be accessed via the internet or a Local Area Network (LAN).

In operation, controller 117 can simultaneously initiate first panel storage device 102 and second panel storage device 104 along storage tracks 110 and 112 to begin feeding panels 300 from storage area 202 to corner drive mechanisms 116 to transition the panels 300 onto main track 118. In some implementations, looped elements of first and second panel storage devices 102 and 104 are simultaneously driven in fixed increments to move the looped elements a fixed distance by starting and stopping in an indexing fashion to feed panels 300 out of storage area 202 one at a time onto corner drive mechanisms 116.

In other implementations, looped elements of first and second panel storage devices 102 and 104 may continuously run for a period of time to deliver multiple panels to corner drive mechanisms 116 in one operation. In such implementations, corner drive mechanisms 116 may operate at a faster speed to clear a received panel out of the way (i.e., past storage track 112 along main track 118) and make room to receive the next panel from first and second panel storage devices 102 and 104. Regardless of whether first and second panel storage devices 102 and 104 operate to feed one or more panels at a time, the speeds and timing of operation between corner drive mechanisms 116 and first and second panel storage devices 102 and 104 may need to be sequenced to clear a panel from the area in front of storage tracks 110 and 112 in time for a next panel.

In feeding panels 300 from storage area 202, controller 117 controls corner drive mechanisms 116 so that a contact element of each corner drive mechanism 116 moves in a first direction (e.g., a clockwise direction in the example of FIG. 1) for receiving panels 300 from first and second panel storage devices 102 and 104. Controller 117 can also control track switch 114 to sequence the movement of a connector track of track switch 114.

In more detail, controller 117 may make sure that the connector track is initially in a position so that storage track 112 is connected to main track 118. After a first portion of a first panel 300 passes the connector track, controller 117 can control track switch 114 to move the connector track so that main track 118 is no longer connected to storage track 112, and main track 118 continues through track switch 114 so that a second portion of the panel 300 can pass through track switch on main track 118. Controller 117 may receive an indication from a sensor that the first portion of the panel 300 has reached or passed the connector track. The sensor may include, for example, a contact sensor, proximity sensor, optical sensor, or switch located on or near track switch 114. In other implementations, controller 117 may control the switching of the connector track based on a speed of corner drive mechanisms 116.

In feeding panels 300 into panel storage system 100 and storage area 202, controller 117 controls corner drive mechanisms 116 so that the contact element of each corner drive mechanism 116 moves in a second direction (e.g., a counter-clockwise direction in the example of FIG. 1) opposite the first direction used for feeding panels 300 out from the first and second panel storage devices 102 and 104. Controller 117 can also control track switch 114 to sequence the movement of the connector track of track switch 114.

In more detail, controller 117 may make sure that the connector track is initially in a position so that main track 118 continues through track switch 114. After a first portion of a panel 300 passes the connector track, controller 117 can control track switch 114 to move the connector track so that storage track 112 connects to main track 118 so that a second portion of the panel 300 can continue onto storage track 112 as the first portion of the panel 300 continues onto storage track 110. Controller 117 may receive an indication from a sensor that the first portion of the panel 300 has reached or passed the connector track. In other implementations, controller 117 may control the switching of the connector track based on a speed of corner drive mechanisms 116.

In feeding panels into storage area 202, controller 117 can simultaneously initiate first panel storage device 102 and second panel storage device 104 along storage tracks 110 and 112 to begin feeding panels 300 from corner drive mechanisms 116 to transition the panels 300 onto storage tracks 110 and 112. Looped elements of first panel storage device 102 and second panel storage device 104 are driven in an opposite direction than when feeding panels out of storage area 202. In some implementations, looped elements of first and second panel storage devices 102 and 104 are simultaneously driven in increments of fixed distances by starting and stopping in an indexing fashion to feed panels 300 into storage area 202 one at a time from corner drive mechanisms 116.

In other implementations, looped elements of first and second panel storage devices 102 and 104 may be continuously run for a period of time to receive multiple panels from corner drive mechanisms 116 in one operation of first and second panel storage devices 102 and 104. In such implementations, corner drive mechanisms 116 may operate at a faster speed to deliver a panel in time to be pushed into storage area 202 by spacers of the first and second panel storage devices 102 and 104. Regardless of whether first and second panel storage devices 102 and 104 operate to feed one or more panels at a time, the speeds and timing of the operation of corner drive mechanisms 116 and first and second panel storage devices 102 and 104 may need to be sequenced so that panels are delivered to first and second panel storage devices 102 and 104 at a rate that allows the panels to be sandwiched between spacers of first and second panel storage devices 102 and 104.

In some implementations, panel identifier detector 115 can be used to indicate to controller 117 that a new panel 300 is ready for movement into storage area 202 via first and second panel storage devices 102 and 104. As discussed above, panel identifier detector 115 can read a panel identifier 302 on panel 300. In addition, panel identifier detector 115 may also be used to sequence corner drive mechanisms 116 to start and stop when a new panel 300 is ready to be fed out of storage area 202.

In other implementations, corner drive mechanisms 116 may run continuously as panels 300 are fed into or out of storage area 202. In addition, some implementations may instead, or in addition to panel identifier detector 115, include a sensor such as a proximity sensor or a physical contact or switch to determine when a new panel 300 is ready to be fed from storage area 202 or fed into storage area 202.

A Variable Frequency Drive (VFD) can be used with motors 103 and 105 to control the speed at which first panel storage device 102 and second panel storage device 104 move panels 300 into or out of panel storage system 100. For example, when panel storage system 100 begins fully loaded with panels 300 in storage area 202 (e.g., as in the example of FIG. 5A discussed below), the voltage and frequency to power motors 103 and 105 may be ramped up to avoid a high inrush current. The voltage and frequency of power supplied to motors 103 and 105 may also be ramped down as first panel storage device 102 and second panel storage device 104 are stopped.

Controller 117 may also adjust the torque output by motors 103 and 105 based on the number of panels in storage area 202. Panel identifier detector 115 or another sensor such as a physical contact switch may allow controller 117 to keep count of the number of panels 300 in storage area 202. As the number of panels 300 in panel storage area 202 increases, controller 117 may increase the torque output by motors 103 and 105 to compensate or adjust for the greater load. As the number of panels 300 in panel storage area 202 decreases, controller 117 may decrease the torque output by motors 103 and 105 to compensate or adjust for the smaller load.

In some implementations, corner drive mechanisms 116 and/or a first drive mechanism 126 outside of panel storage system 100 may also allow for panels 300 to be driven at different speeds than at other locations in the wall partition movement system. This may be done by tuning the motors of these components or by more dynamically using a VFD. In such examples, the speed of a first drive mechanism 126 and/or corner drive mechanisms 116 in panel storage system 100 can be adjusted to provide for slowing panels 300 down as they enter or exit panel storage system 100.

First and second panel storage devices 102 and 104 may also include one or more limit switches configured to stop motors 103 and 105 from driving looped elements if a current limit in supplying power to a motor is exceeded. This can ordinarily provide a safety measure and prevent damage to the motors if an obstacle is blocking a path of travel of a panel.

Motors 103 and 105 may also include a clutch that disengages or stops the motor from driving a looped element after encountering a resistance to rotation. The clutches or stopping of motors 103 and 105 can also be controlled by controller 117 so that controller 117 can disengage the motors or stop movement of a panel 300 through an override switch or an input received from an operator at controller 117. Similarly, the direction of movement of the looped elements can be controlled by controlling the output of motors 103 and 105 so that the looped elements are moved in a clockwise or counter-clockwise direction corresponding to feeding panels 300 into or out of storage area 202.

As appreciated by those of ordinary skill in the art, the wall partition movement system and wall panel storage system 100 in other implementations can include more or less components than those shown in FIG. 1. For example, in some implementations, wall panel storage system 100 may not connect with an automated wall partition movement system as in the example in FIG. 1. In such implementations, wall panel storage system 100 may be used to feed panels out of or into storage area 202, with the panels being manually moved along tracks by operators. In addition, other implementations of wall panel storage system 100 may be arranged below panels 300, rather than above panels 300, or may include a different number of panel storage devices.

Figure 2:
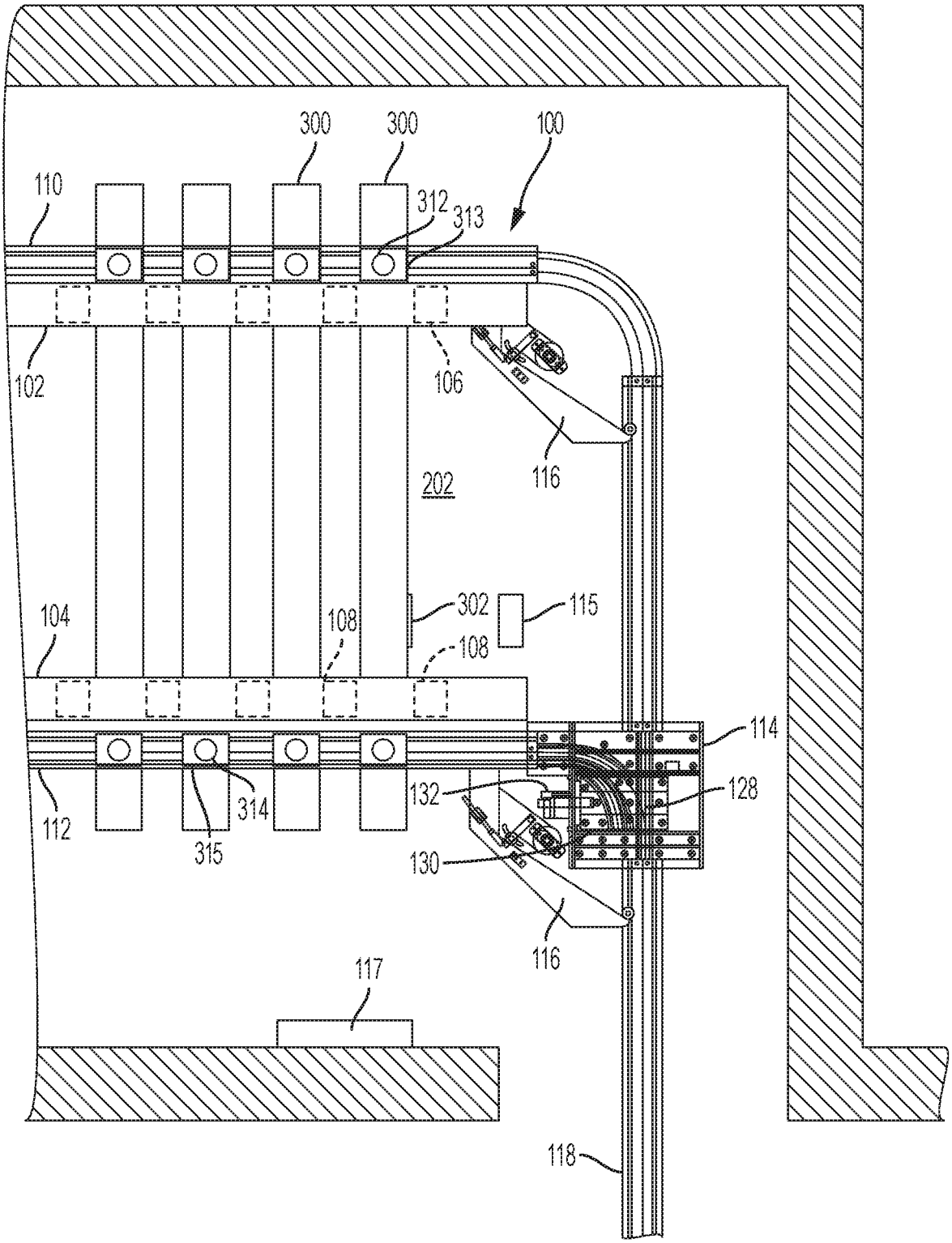
FIG. 2 is a top view of a portion of the panel storage system of FIG. 1.

FIG. 2 is a top view of a portion of storage area 202 and panel storage system 100. As shown in FIG. 2, panels 300 include trollies 313 and 315 on opposite end portions of panels 300. Trollies 313 and 315 are connected to suspension rods 312 and 314, respectively, and are configured to engage with main track 118, and storage tracks 110 and 112 so that panels 300 may travel on these tracks. In one implementation, suspension rods 312 and 314 can include pendant bolts affixed to panel 300 approximately along a centerline along a width of panel 300. Trollies 313 and 315 can include wheels that vertically rotate about suspension rods 312 and 314 so that trollies 313 and 315 can change their orientation as a panel 300 moves to storage tracks 110 and 112 from main track 118, or to main track 118 from storage tracks 110 and 112.

First panel storage device 102 and second panel storage device 104 are arranged with respect to storage tracks 110 and 112 so that the lengths of panels 300 are parallel to each other when stored in storage area 202. In other words, panels 300 are stored in panel storage system 100 with their lengths side by side to each other such that the distance between the panel lengths have the same distance continually between them. By storing panels 300 with their lengths parallel to each other, as opposed to storing the panels linearly along a single track, the size of storage area 202 can be significantly reduced.

In the example of FIG. 2, first panel storage device 102 and second panel storage device 104 are located below and within storage tracks 110 and 112. In other implementations, first panel storage device 102 and second panel storage device 104 can be located outside of and/or above storage tracks 110 and 112. Other embodiments may also include a different number of panel storage devices in panel storage system 100, such as a single panel storage device between storage tracks 110 and 112, or three panel storage devices for moving relatively large or heavy panels. In this regard, panels 300 in some implementations can each weigh several hundred pounds and extend over five feet in length. Additional storage tracks may also be used in some implementations based on the size or weight of panels 300.

Figure 4:
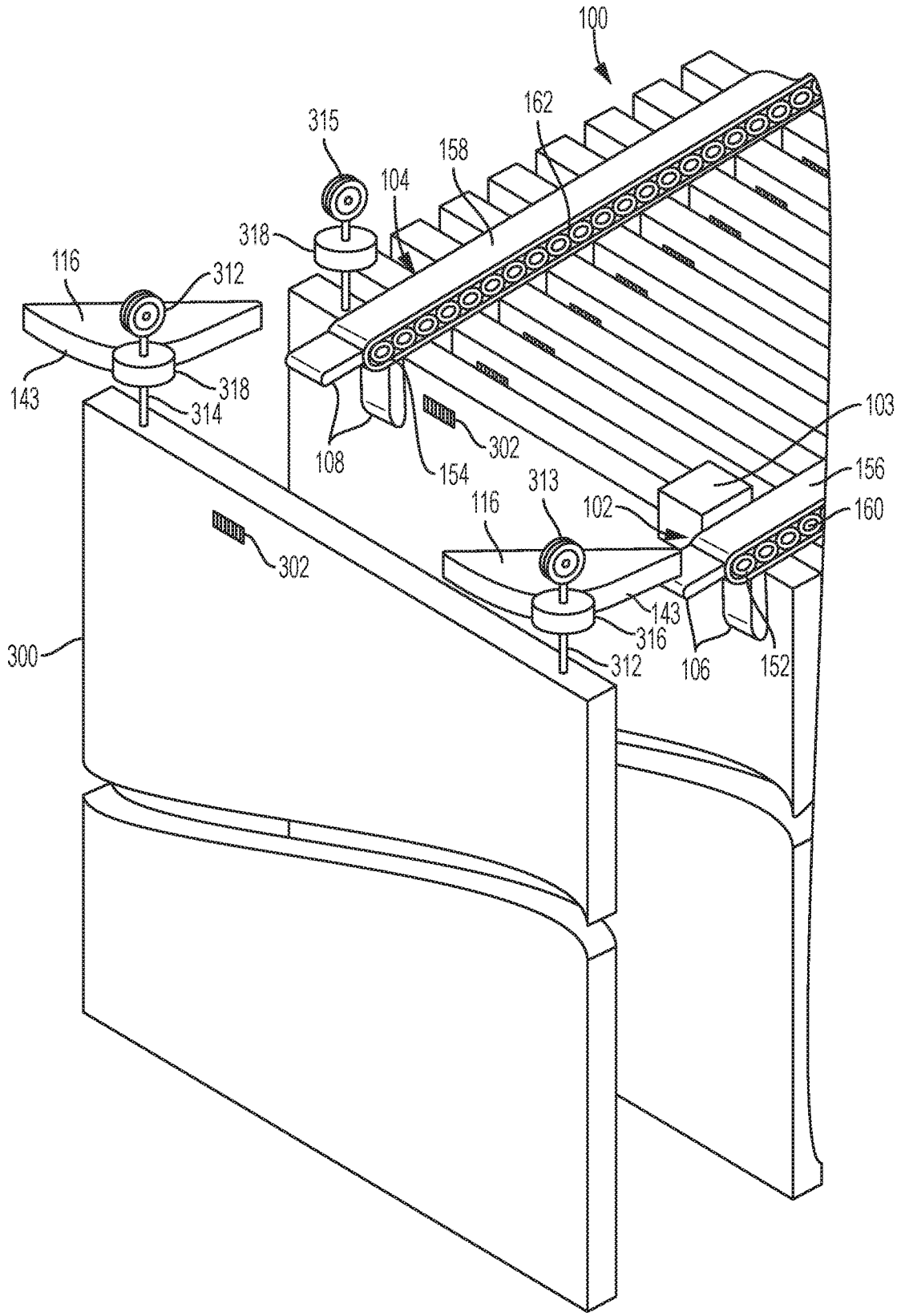
FIG. 4 is an isometric view of the panel storage system of FIGS. 1 and 2.

As shown in FIG. 2, each of first panel storage device 102 and second panel storage device 104 include a plurality of spacers 106 and 108, respectively, configured to fit between a pair of panels 300 to move a panel of the pair of panels into or out of storage area 202 or panel storage system 100 when first panel storage device 102 and second panel storage device 104 drive a respective looped element (e.g., looped elements 156 and 158 in FIG. 4). Each spacer between a first and last pair of spacers is configured to fit between a pair of panels 300. In this regard, each spacer is evenly spaced from at least one other spacer along its respective panel storage device. The thickness of each spacer can be equal to or less than the thickness of a panel to further conserve space in storage area 202.

Spacers 106 and 108 can be made of a material to protect panels from damage that may otherwise result from contact with the spacers or with other panels. Such protective materials can include, for example, a rubber material or plastic materials such as High-Density Polyethylene (HDPE), Plyvinyl Chloride (PVC), Low-Density Polyethylene (LDPE), Polypropylene (PP), or Polycarbonate (PC). In some implementations, spacers 106 and 108 may be integral with looped elements moving the spacers.

As shown in FIG. 2, track switch 114 includes track connector 128 that is actuated by track switch 114 between a first position and a second position. With track connector 128 in the first position as shown in FIG. 2, track connector 128 connects to ends of main track 118 on opposite ends of track switch 114 so that main track 118 goes through track switch 114. To move to the second position, track switch 114 actuates track connector 128 (i.e., to the right in FIG. 2), such as by using a piston, to connect the end of storage track 112 to one end of main track 118 leading away from panel storage system 100.

As discussed above, in feeding a panel 300 into storage area 202, the actuation of track connector 128 can be sequenced so that after trolley 313 passes track switch 114, track connector 128 is moved from the first position to the second position so that trolley 315 is guided to storage track 112 as trolley 313 is guided to storage track 110. In feeding a panel 300 out from storage area 202, the actuation of track connector 128 is reversed so that after trolley 315 passes track switch 114, track connector 128 is moved to the first position (e.g., to the left in FIG. 2) so that trolley 313 is guided to main track 118 passing through track switch 114.

In the example of FIG. 2, each of panel storage device 102 and panel storage device 104 is fed by a corner drive mechanism 116. In some implementations, a contact element such as a belt or chain of corner drive mechanism 116 can contact a portion of panel 300, such as a drivable element like a contact wheel on a suspension rod below the trolley.

Figure 3:
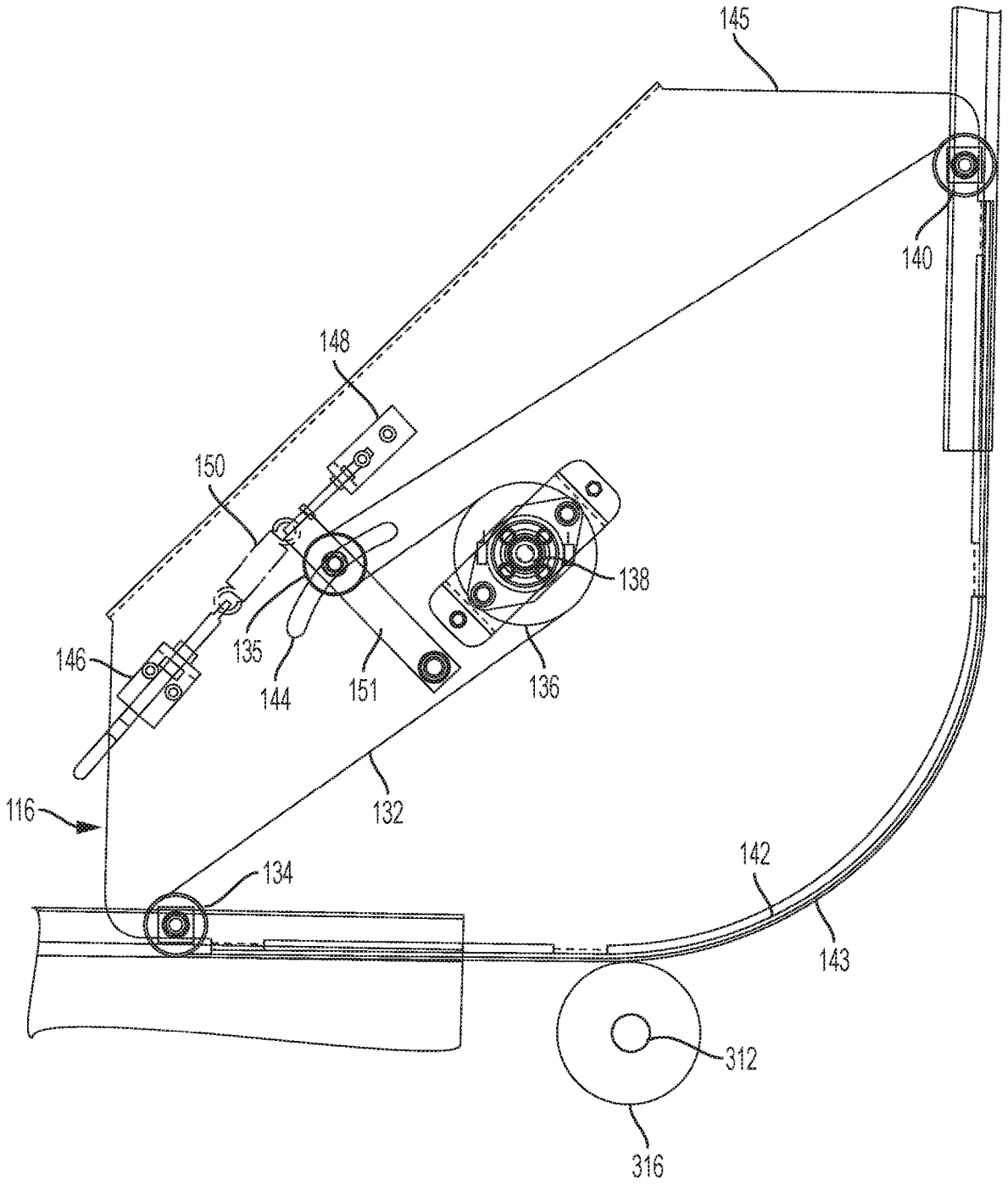
FIG. 3 is a detailed view of a corner drive mechanism in the storage area of FIG. 2 according to an embodiment.

FIG. 3 provides a more detailed view of corner drive mechanism 116 according to an embodiment. As shown in FIG. 3, corner drive mechanism 116 includes contact element 143, which can be, for example, a chain or a belt such as a friction or timing belt. Contact element 143 has an exterior side for contacting drivable element 316 of a panel 300, such as a rubber wheel centered on suspension rod 314. In other implementations, drivable element 316 can be a sprocket that engages with contact element 143, which can be a chain.

An interior side of contact element 143 contacts curved guide 142 of corner drive mechanism 116. Curved guide 142 guides contact element 143 along curved guide 142 so that drivable element 316 of panel 300 can be carried or led in the direction that contact element 143 is being moved to thereby move panel 300 onto or from a storage track, depending on the direction of movement of contact element 143. As drivable element 316 moves along curved guide 142, the point of contact between drivable element 316 and contact element 143 may change, such as when contact element 143 is a chain or timing belt that progresses along teeth of drivable element 316. In other implementations, drivable element 316 may rotate about suspension rod 314 as drivable element 316 moves along curved guide 142.

In the example of FIG. 3, contact element 143 is looped around rollers 134 and 140, drive wheel 136, and tension roller 135. Motor 138 is configured to drive contact element 143 via drive wheel 136 around rollers 134 and 140, and around curved guide 142 to change a direction of travel of a panel 300 through contact with drivable element 316.

Drivable element 316 is affixed on suspension rod 314 so as to contact or engage contact element 143 of corner drive mechanism 116. Corner drive mechanism 116 includes curved guide 142 which provides a surface against which contact element 143 moves to ensure contact between contact element 143 and drivable element 316. In some implementations, curved guide 142 and contact element 143 can be approximately 0.50 to 2 inches in height. The height of contact element 143 and curved guide 142 can vary based on design considerations such as a weight of the panels or the torque of motor 138.

As shown in FIG. 3, the components of corner drive mechanism 116 are mounted on frame 145. Motor 138 of corner drive mechanism 116 rotates drive wheel 136 to drive contact element 143 around rollers 134 and 140, and around tension roller 135. Drive wheel 136 also drives contact element 143 along curved guide 142.

Tension roller 135 can be used to facilitate removal of contact element 143 for replacement or maintenance. Tension roller 135 is mounted on tension arm 151 and is moved along slot 144 in frame 145 against the resistance of spring 150 when removing contact element 143 to loosen contact element 143. The tension of spring 150 and the location of tension roller 135 in slot 144 can be adjusted using tension adjusters 146 and 148. In other embodiments, a gas cylinder or other mechanism for maintaining tension of contact element 143 can be used instead of spring 150. In yet other embodiments, tension roller 135, slot 144, spring 150, tension adjusters 146 and 148, and tension arm 151 can be omitted.

The embodiment of FIG. 3 also allows for replacement, repair or adjustment of other components, such as drivable element 316, which may become worn after significant use. For example, after drivable element 316 becomes worn or as part of a routine maintenance operation, drivable element 316 can be repositioned or turned about suspension rod 314 so that a different outer portion of drivable element 316 contacts contact element 143. In this way, it is ordinarily possible to prolong the usable life of drivable element 316.

Corner drive mechanism 116 may also include a torque limiter to protect contact element 143 from over-tensioning. In other implementations, an electric clutch can disengage motor 138 when a current limit is exceeded so as to protect contact element 143 from over-tensioning. Motor 138 can be sized based on various design considerations such as power supply or a weight of panels 300. In one implementation, motor 138 can provide a torque of approximately 50 inch-pounds and rotate at a speed of approximately 50 revolutions per minute. The specifications of motor 138 can vary in other implementations.

In some embodiments, motor 138 may include a magnetic starter to allow for motor 138 to start after rotation of drive wheel 136 to allow for the automatic starting of corner drive mechanism 116 after being fed a panel 300, such as by a first drive mechanism 126 or from a panel storage device. In addition, motor 138 may also include a clutch that disengages or stops motor 138 from driving drive wheel 136 after encountering a resistance to rotation of drive wheel 136. In other implementations, motor 138 may stop on its own after encountering a resistance to rotation of drive wheel 136. Such resistance to rotation may be detected from a current used by motor 138 exceeding a current limit. In such an implementation, corner drive mechanism 116 can automatically stop when a panel 300 driven by corner drive mechanism 116 reaches a position where spacers of first and second panel storage devices 102 and 104 prevent further movement of the panel 300 into storage area 202. In addition, such an automatic stop can also serve as a safety feature to cause the panel 300 to automatically stop when encountering an obstacle along its path.

The clutches or stopping of motor 138 can also be controlled by controller 117 so that controller 117 can sequence the motor 138 off or can stop movement of a panel 300 through an override switch or an input received from an operator at controller 117. Similarly, the direction of movement of contact element 143 can be controlled by controlling the output of motor 138 so that contact element 143 is moved in a clockwise or counter-clockwise direction corresponding to feeding panels 300 into or out of storage area 202.

FIG. 4 is an isometric view of panel storage system 100. As shown in FIG. 4, a panel 300 is either being fed from storage area 202 or fed into storage area 202 by panel storage system 100. In the example of FIG. 4, each panel 300 includes a bar code as a panel identifier 302 that allows controller 117 to identify the panels 300 as they are fed into or fed out of storage area 202.

Trollies 313 and 315 are connected to suspension rods 312 and 314, respectively, for engaging storage tracks 110 and 112 (as shown in FIG. 2 discussed above). Drivable elements 316 and 318 are driven by contact elements 143 of corner drive mechanisms 116.

As shown in FIG. 4, spacers 106 and 108 of first and second panel storage devices 102 and 104 overlap respective areas beneath an end portion of corner drive mechanisms 116. This arrangement allows for the handing off or delivering of panels between corner drive mechanisms 116 and spacers 106 and 108 of first and second panel storage devices 102 and 104.

When spacers 106 and 108 push a panel 300 out of storage area 202, the panel 300 is handed off or delivered to corner drive mechanisms 116 with contact elements 143 grabbing or pulling drivable elements 316 and 318 to move panel 300 away from spacers 106 and 108. Looped elements 156 and 158 move or rotate in a first direction (e.g., clockwise in the example of FIG. 4) as spacers 106 and 108 lose contact with the panel 300. Corner drive mechanisms 116 then move the panel 300 via trollies 313 and 315 onto main track 118.

Panel 300 is handed off or delivered from corner drive mechanisms 116 to spacers 106 and 108 with contact elements 143 grabbing or pulling drivable elements 316 and 318 toward spacers 106 and 108. Looped elements 156 and 158 move or rotate in a second direction opposite the first direction (e.g., counter-clockwise in the example of FIG. 4) as spacers 106 and 108 contact panel 300. Spacers 106 and 108 then move the panel 300 via trollies 313 and 315 along storage tracks 110 and 112 into storage area 202.

In some implementations, controller 117 may control corner drive mechanisms 116 to move contact elements 143 in a first direction for feeding panel 300 into first and second storage devices 102 and 104. Controller 117 may also control corner drive mechanisms 116 to move contact elements 143 in a second direction opposite the first direction for feeding panel 300 out of first and second storage devices 102 and 104. In other implementations, corner drive mechanisms 116 may automatically start or stop in the first or second directions by using a magnetic starter as discussed above with reference to FIG. 3.

As shown in FIG. 4, spacers 106 and 108 are attached to looped elements 156 and 158, respectively, such that the lengths of each panel 300 in storage area 202 is kept parallel to each other. In this regard, spacers 106 are aligned with spacers 108 so that aligned pairs of spacers 106 and 108 fit between pairs of panels 300. Spacers 106 are aligned with spacers 108 so that at least one aligned pair of spacers is evenly spaced from at least one other aligned pair of spacers on looped elements 156 and 158. By storing panels 300 with their lengths arranged parallel to each other, it is ordinarily possible to reduce the space needed for storage area 202. In addition, sizing a thickness of spacers 106 and 108 to less than or equal to a thickness of panels 300 can further reduce the space needed for storage area 202.

As discussed above, spacers 106 and 108 may be formed of a protective material such as rubber or plastic to reduce damage to panels 300 in storage area 202, which may otherwise be caused by contact with other panels. In addition, spacers 106 and 108 may have rounded edges as shown in FIG. 4 to facilitate a smooth transition into or out of storage area 202 as spacers 106 begin to contact panel 300 or lose contact with panel 300.

Looped elements 156 and 158 can include, for example, a conveyor belt or chain. Spacers 106 and 108 are attached to looped elements 156 and 158, respectively, by being mechanically or otherwise attached or affixed, or may be integrally formed as part of looped elements 156 and 158. In the example of FIG. 4, looped elements 156 and 158 are driven or moved by powered wheels 152 and 154, respectively. In some implementations, powered wheels 152 and 154 can include sprockets that engage looped elements 156 and 158, which can be chains. In other implementations, powered wheels 152 and 154 can include powered pullies that engage looped elements 156 and 158, which can be belts, such as a conveyor belt or a timing belt.

Powered wheels 152 and 154 are driven by motors 103 and 105 (not shown in FIG. 4), respectively. Some implementations may include additional powered wheels along looped elements 156 which may be driven by additional motors. The number of powered wheels and motors can vary based on design considerations such as the number and weight of panels to be stored in storage area 202.

As shown in the example of FIG. 4, looped elements 156 and 158 are supported by rollers 160 and 162. In other implementations, some or all of rollers 160 and 162 along looped elements 156 and 158 may be replaced by a flat pan or guide to support looped elements 156 and 158.

As discussed above, powered wheels 152 and 154 may be driven based on a number of panels 300 in storage area 202. For example, controller 117 may adjust the torque output by motors 103 and 105 based on a number of panels 300 determined to be in storage area 202. Panel identifier detector 115 may be used to keep track of the number of panels in storage area 202 that are currently being handled by first and second storage devices 102 and 104. Controller 117 may then increase the torque output by motors 103 and 105 when panels are added to storage area 202, and decrease the torque output by motors 103 and 105 when panels leave storage area 202. In other implementations, the number of panels in storage area 202 may be monitored by other means, such as with a contact or proximity sensor.

Figure 5A:
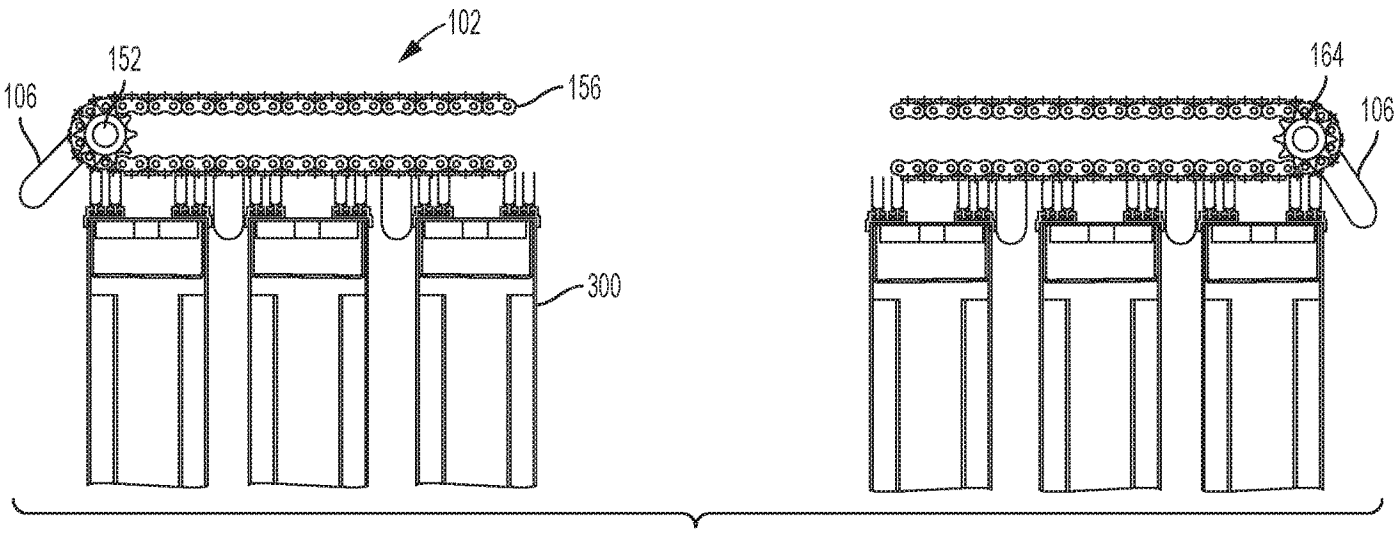
FIG. 5A is a side view of panels in an initial storage position between spacers of a panel storage device according to an embodiment.

FIG. 5A is a side view of panels 300 in an initial storage position between spacers 106 of panel storage device 102. The middle portion of panel storage device 102 has been removed in FIG. 5A to show end portions of panel storage device 102 in the initial storage position. As shown in FIG. 5A, spacers 106 are arranged on looped element 156 so that each spacer 106 is evenly spaced from at least one other spacer 106. The even spacing between spacers 106 approximately equals the thickness of a panel 300 with some additional tolerance added to the panel thickness. This even spacing is similarly followed with spacers 108 on looped element 158 of second panel storage device 104 so that aligned pairs of spacers from spacers 106 and 108 are evenly spaced from at least one other aligned pair of spacers.

The example of FIG. 5A includes a remaining portion of looped element 156 between a first spacer and a last spacer where no spacers are attached to looped element 156. The remaining portion is longer than the even spacing between spacers 106. Similarly, looped element 158 of second panel storage device 104 includes a remaining portion with no spacers 108 between a first and last spacer 108, such that the remaining portions of looped elements 156 and 158 are each longer than the even spacing between the aligned pairs of spacers from spacers 106 and 108. In other implementations, spacers 108 and 106 may continue around a full length of looped elements 156 and 158.

In FIG. 5A, looped element 156 is shown as a chain that is driven by powered wheels 152 and 164, which in the example of FIG. 5A, are sprockets that engage looped element 156. Powered wheel 152 can be driven by motor 103, and powered wheel 164 may or may not be driven by its own motor. As noted above, different implementations of panel storage device 102 may include a different number of powered wheels and/or motors. In implementations where looped element 156 is a belt, such as a conveyor belt or timing belt, powered wheels 152 and 164 may be powered pullies instead of sprockets as in FIG. 5A.

As shown in FIG. 5A, first panel storage device 102 is fully loaded with panels 300 between each spacer 106 in the initial position. When panels 300 are fed from storage area 202, first panel storage device 102 can incrementally push panels 300 out from storage area 202 one at a time using spacers 106 that are incrementally moved a fixed distance of at least one panel thickness by looped element 156. In some implementations, looped element 156 may be continuously run to push out multiple panels 300 at a time, rather than incrementally run to push out a single panel at a time. In such implementations, corner drive mechanisms 116 may operate fast enough to clear one panel along main track 118 out of the way of a next panel to be pushed out of storage area 202 by first and second panel storage devices 102 and 104.

Figure 5B:
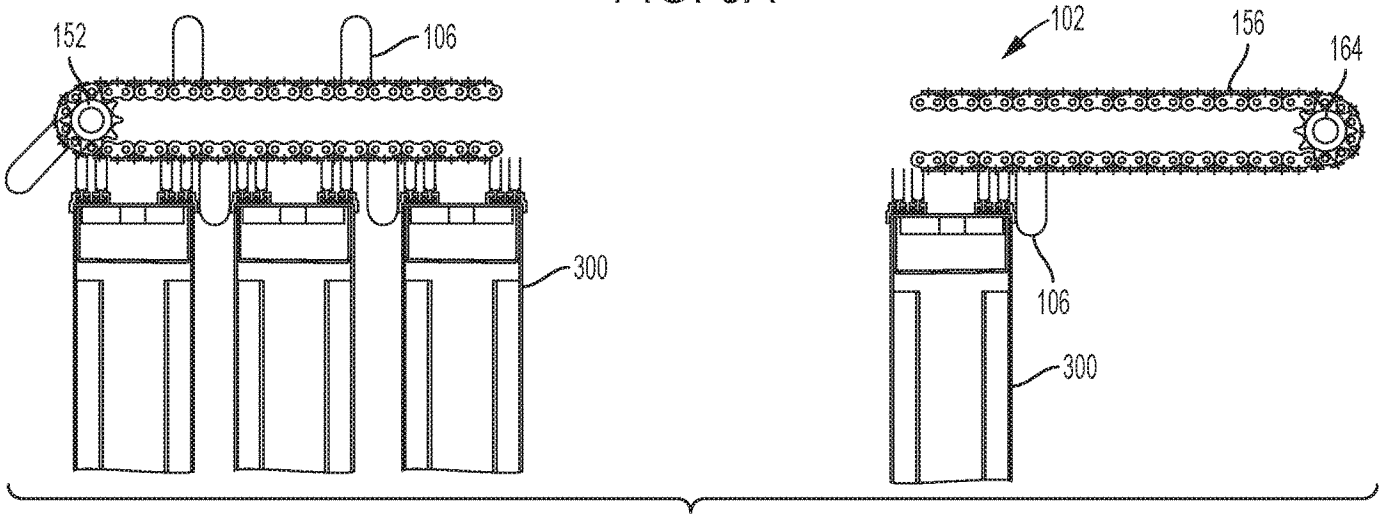
FIG. 5B is a side view of the panel storage device of FIG. 5A after two of the panels have been fed out from the initial storage position.

FIG. 5B is a side view of panel storage device 102 of FIG. 5A after two of the panels have been fed out from the initial position shown in FIG. 5A. As shown in FIG. 5B, two less panels 300 are at the end portion of panel storage device 104 on the right side of FIG. 5B than shown in FIG. 5A. The two missing panels have progressed by two panels to the middle portion of panel storage device 102, and two panels 300 from the end portion shown on the left side of FIG. 5B have been fed out of storage area 202. Spacers 106 for the two panels that left storage area 202 have traveled to the top of looped element 156 in the left side of FIG. 5B. Looped element 156 has progressed or traveled in a clockwise direction in FIG. 5B to push or move panels out from storage area 202. As a spacer 106 rounds the end portion of looped element 156 near powered wheel 152, it pushes a panel out of panel storage device 102, and onto corner drive mechanism 116. The panels behind the panel pushed out, if any, are carried forward toward corner drive mechanism 116 by pairs of spacers 106 on looped element 156 that sandwich the panels.

When receiving panels into storage area 202, looped element 156 progresses or travels in the opposite direction (i.e., counter-clockwise in FIG. 5B) to move spacers 106 from the top of looped element 156 to the bottom of looped element 156. As a spacer 106 rounds the end portion of looped element 156 near powered wheel 152, it pushes a panel from corner drive mechanism 116 into panel storage device 102. The panels ahead of the newly added panel, if any, are carried farther back into storage area 202 by pairs of spacers 106 on looped element 156 that sandwich the panels.

As discussed above, storing panels with their lengths parallel to each other can reduce the space needed to store panels as compared to other storage arrangements where panels are stored along a single track with their lengths in line with each other. The spacers of the disclosed panel storage system also help protect panels from damage, while allowing for a more compact storage of panels.

In addition, the use of the panel storage system described herein can ordinarily allow the feeding of panels to and from a storage area to be performed with less operators and in less time than it takes to manually feed panels into or out of a storage area.

Those of ordinary skill in the art will appreciate that the various illustrative logical blocks, modules, and processes described in connection with the examples disclosed herein may be implemented as electronic hardware, computer software, or combinations of both. Furthermore, the foregoing processes can be embodied on a computer readable medium which causes a processor, controller, or computer to perform or execute certain functions.

To clearly illustrate this interchangeability of hardware and software, various illustrative components, blocks, and modules have been described above generally in terms of their functionality. Whether such functionality is implemented as hardware or software depends upon the particular application and design constraints imposed on the overall system. Those of ordinary skill in the art may implement the described functionality in varying ways for each particular application, but such implementation decisions should not be interpreted as causing a departure from the scope of the present disclosure.

The various illustrative logical blocks, units, modules, and controllers described in connection with the examples disclosed herein may be implemented or performed with a general purpose processor, a Digital Signal processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The activities of a method or process described in connection with the examples disclosed herein may be embodied directly in hardware, in a software module executed by a processor, or in a combination of the two. The steps of the method or algorithm may also be performed in an alternate order from those provided in the examples. A software module may reside in RAM memory, flash memory, ROM memory, EPROM memory, EEPROM memory, registers, hard disk, a removable media, an optical media, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the scope of the present disclosure. The described embodiments are to be considered in all respects only as illustrative and not restrictive and the scope of the disclosure is, therefore, indicated by the following claims rather than by the foregoing description. All changes which come within the meaning and range of equivalency of the claims are to be embraced within their scope. In addition, the use of language in the form of "at least one of A and B" in the following claims should be understood to mean "only A, only B, or both A and B."

What is claimed is:

1. A wall panel storage system, comprising:
- a looped element;
- a motor for driving the looped element; and
- a plurality of spacers attached to the looped element with at least one spacer of the plurality of spacers being configured to be sandwiched between a pair of panels to move a panel of the pair of panels into or out of a storage area along a storage track when the motor drives the looped element.

2. The wall panel storage system of claim 1, wherein each spacer between a first spacer and a last spacer of the plurality of spacers is configured to be inserted between a respective pair of panels.

3. The wall panel storage system of claim 1, wherein the motor is configured to drive the looped element a fixed distance in a first direction to move at least one panel into the storage area, and wherein the motor is further configured to drive the looped element the fixed distance in a second direction opposite the first direction to move the at least one panel out of the storage area.

4. The wall panel storage system of claim 1, further comprising a panel identification detector configured to detect an identifier on one or more panels that identifies the panel.

5. The wall panel storage system of claim 1, further comprising:
- a track switch including a connector track for connecting the storage track to a main track; and
- a controller configured to:
  - receive an indication that a first portion of a panel has passed the connector track along the main track for storage of the panel in the storage area; and
  - control the track switch to move the connector track to connect the storage track to the main track before a second portion of the panel reaches the connector track.

6. The wall panel storage system of claim 1, further comprising a corner drive mechanism located proximate an end portion of the storage track along a main track orientated perpendicular to the storage track, the corner drive mechanism including a contact element configured to feed a panel to a spacer of the plurality of spacers or from a spacer of the plurality of spacers.

7. The wall panel storage system of claim 1, further comprising a corner drive mechanism including:
- a contact element including an interior side and an exterior side opposite the interior side, wherein the exterior side is configured to contact the wall panel;
- at least one roller in contact with the interior side of the contact element;
- a curved guide in contact with the interior side of the contact element; and
- a corner drive motor configured to drive the contact element around the at least one roller and the curved guide so as to change a direction of travel of the wall panel from a main track onto the storage track or from the storage track onto the main track.

8. A wall panel storage system, comprising:
- a looped element;
- a motor for driving the looped element; and
- a plurality of spacers attached to the looped element with at least one spacer of the plurality of spacers being configured to fit between a pair of panels to move a panel of the pair of panels into or out of a storage area along a storage track by contacting a planar front surface or a planar rear surface of the panel when the motor drives the looped element.

9. The wall panel storage system of claim 8, wherein each spacer between a first spacer and a last spacer of the plurality of spacers is configured to fit vertically between a respective pair of panels.

10. The wall panel storage system of claim 8, wherein the motor is configured to drive the looped element a fixed distance in a first direction to move at least one panel into the storage area, and wherein the motor is further configured to drive the looped element the fixed distance in a second direction opposite the first direction to move the at least one panel out of the storage area.

11. The wall panel storage system of claim 8, further comprising a panel identification detector configured to detect an identifier on one or more panels that identifies the panel.

12. The wall panel storage system of claim 8, further comprising:

a track switch including a connector track for connecting the storage track to a main track; and a controller configured to:

receive an indication that a first portion of a panel has passed the connector track along the main track for storage of the panel in the storage area; and control the track switch to move the connector track to connect the storage track to the main track before a second portion of the panel reaches the connector track.

13. The wall panel storage system of claim 8, further comprising a corner drive mechanism located proximate an end portion of the storage track along a main track orientated perpendicular to the storage track, the corner drive mechanism including a contact element configured to feed a panel to a spacer of the plurality of spacers or from a spacer of the plurality of spacers.

14. The wall panel storage system of claim 8, further comprising a corner drive mechanism including:

a contact element including an interior side and an exterior side opposite the interior side, wherein the exterior side is configured to contact the wall panel;

at least one roller in contact with the interior side of the contact element;

a curved guide in contact with the interior side of the contact element; and a corner drive motor configured to drive the contact element around the at least one roller and the curved guide so as to change a direction of travel of the wall panel from a main track onto the storage track or from the storage track onto the main track.

15. A wall panel storage system, comprising:

a looped element;

a motor for driving the looped element in a clockwise direction or a counter-clockwise direction in a vertical plane; and a plurality of spacers attached to the looped element with at least one spacer of the plurality of spacers configured to be inserted between a pair of panels to move a panel of the pair of panels into or out of a storage area along a storage track when the motor drives the looped element.

16. The wall panel storage system of claim 15, wherein each spacer between a first spacer and a last spacer of the plurality of spacers is configured to fit vertically between a respective pair of panels.

17. The wall panel storage system of claim 15, wherein the motor is configured to drive the looped element a fixed distance in a first direction to move at least one panel into the storage area, and wherein the motor is further configured to drive the looped element the fixed distance in a second direction opposite the first direction to move the at least one panel out of the storage area.

18. The wall panel storage system of claim 15, further comprising a panel identification detector configured to detect an identifier on one or more panels that identifies the panel.

19. The wall panel storage system of claim 15, further comprising:

a track switch including a connector track for connecting the storage track to a main track; and a controller configured to:

receive an indication that a first portion of a panel has passed the connector track along the main track for storage of the panel in the storage area; and control the track switch to move the connector track to connect the storage track to the main track before a second portion of the panel reaches the connector track.

20. The wall panel storage system of claim 15, further comprising a corner drive mechanism located proximate an end portion of the storage track along a main track orientated perpendicular to the storage track, the corner drive mechanism including a contact element configured to feed a panel to a spacer of the plurality of spacers or from a spacer of the plurality of spacers.

21. The wall panel storage system of claim 15, further comprising a corner drive mechanism including:

a contact element including an interior side and an exterior side opposite the interior side, wherein the exterior side is configured to contact the wall panel;

at least one roller in contact with the interior side of the contact element;

a curved guide in contact with the interior side of the contact element; and a corner drive motor configured to drive the contact element around the at least one roller and the curved guide so as to change a direction of travel of the wall panel from a main track onto the storage track or from the storage track onto the main track.

* * * * *